US012545486B2

(12) United States Patent
García Cendejas

(10) Patent No.: US 12,545,486 B2
(45) Date of Patent: Feb. 10, 2026

(54) EDIBLE CAN HOLDER WITH FLAPS

(71) Applicant: E6PR S.A.P.I. DE C.V., Mexico City (MX)

(72) Inventor: Juan Francisco García Cendejas, Mexico City (MX)

( * ) Notice: Subject to any disclaimer, the term of this patent is extended or adjusted under 35 U.S.C. 154(b) by 149 days.

(21) Appl. No.: 17/761,994

(22) PCT Filed: Sep. 8, 2020

(86) PCT No.: PCT/MX2020/050032
§ 371 (c)(1),
(2) Date: Mar. 18, 2022

(87) PCT Pub. No.: WO2021/054814
PCT Pub. Date: Mar. 25, 2021

(65) Prior Publication Data

US 2022/0332487 A1 Oct. 20, 2022

(30) Foreign Application Priority Data

Sep. 20, 2019 (MX) ..... MX/u/2019/000467

(51) Int. Cl.
*B65D 71/50* (2006.01)
*B65D 65/46* (2006.01)

(52) U.S. Cl.
CPC ..... *B65D 71/50* (2013.01); *B65D 65/463* (2013.01); *B65D 65/466* (2013.01)

(58) Field of Classification Search
CPC .... B65D 71/50; B65D 65/463; B65D 65/466; B65D 71/504; B65B 17/025; B65B 43/42; Y02W 90/10
See application file for complete search history.

(56) References Cited

U.S. PATENT DOCUMENTS

| | | | |
|---|---|---|---|
| 2,929,181 | A | 3/1960 | Poupitch |
| 2,936,070 | A | 5/1960 | Poupitch |
| 3,200,944 | A | 8/1965 | Rapata |
| 3,300,041 | A | 1/1967 | Fuller |
| 3,346,106 | A | 10/1967 | Gooding |
| 3,664,497 | A | 5/1972 | Mascia |

(Continued)

FOREIGN PATENT DOCUMENTS

| | | | |
|---|---|---|---|
| BR | 302017005050-6 | A1 | 5/2018 |
| CA | 2101414 | A1 | 1/1994 |

(Continued)

OTHER PUBLICATIONS

International Preliminary Report on Patentability of PCT/MX2020/050032 with English translation.

(Continued)

*Primary Examiner* — Andrew D Perreault
(74) *Attorney, Agent, or Firm* — Mayer Brown LLP

(57) ABSTRACT

The utility model of the present invention relates to a modification in the configuration and structure of a can holder (10) produced from a biodegradable pulp paste, recycled, 100% biological, compostable and edible. This modification refers to a fin (13), protrusion, flange, tapered region or tongue of a thickness (E) between 0.75 mm. to 1.8 mm and whose radial (R1), in its widest region, is 20 mm of radius, placed in each of the corners of the can holder (10).

7 Claims, 4 Drawing Sheets

(56) References Cited

U.S. PATENT DOCUMENTS

| | | | | |
|---|---|---|---|---|
| 3,935,967 | A | 2/1976 | Doucette | |
| 4,005,644 | A | 2/1977 | Tranquillitsky | |
| 4,120,396 | A | 10/1978 | Mascia et al. | |
| 4,136,772 | A | 1/1979 | Mascia et al. | |
| 4,139,094 | A | 2/1979 | Berry et al. | |
| 4,332,325 | A | 6/1982 | Manizza | |
| D270,428 | S | 9/1983 | Arfert | |
| 4,453,630 | A | 6/1984 | Helms et al. | |
| 4,574,949 | A | 3/1986 | Rhoads | |
| 5,186,321 | A | 2/1993 | Fadus | |
| 5,221,002 | A | 6/1993 | Garganese | |
| D342,023 | S | 12/1993 | Bonkowski | |
| 5,285,892 | A | 2/1994 | Adami et al. | |
| 5,320,216 | A | 6/1994 | Pangborn | |
| 5,356,518 | A | 10/1994 | Kelley et al. | |
| D354,227 | S | 1/1995 | Adami et al. | |
| 5,415,278 | A | 5/1995 | Sutherland | |
| 5,503,267 | A | 4/1996 | Sutherland | |
| 5,551,566 | A | 9/1996 | Sutherland | |
| 5,553,704 | A | 9/1996 | Gordon et al. | |
| 5,562,205 | A | 10/1996 | Diaz | |
| D430,014 | S | 8/2000 | Hackmeister | |
| 6,129,397 | A | 10/2000 | Borg | |
| 6,361,746 | B1 | 3/2002 | Wlodarski | |
| 6,973,760 | B2 | 12/2005 | Moore | |
| D653,560 | S | 2/2012 | Smithers | |
| 8,262,960 | B2 | 9/2012 | Kimura | |
| D700,526 | S | 3/2014 | Borg et al. | |
| D705,666 | S | 5/2014 | Borg et al. | |
| D721,598 | S | 1/2015 | Borg | |
| D722,891 | S | 2/2015 | Borg et al. | |
| D786,702 | S | 5/2017 | Borg et al. | |
| 9,986,860 | B2 | 6/2018 | Hawley et al. | |
| D854,424 | S | 7/2019 | Lauria et al. | |
| 2004/0003573 | A1 | 1/2004 | Moore | |
| 2005/0138887 | A1 | 6/2005 | Kanachowski | |
| 2005/0139500 | A1 | 6/2005 | Smithers | |
| 2010/0062248 | A1 | 3/2010 | Kimura et al. | |
| 2010/0206752 | A1* | 8/2010 | Nikitczuk | A61F 6/005 206/69 |
| 2011/0028427 | A1 | 2/2011 | McManus | |
| 2012/0305010 | A1 | 12/2012 | Mishra et al. | |
| 2014/0300026 | A1 | 10/2014 | Taccolini | |
| 2015/0191287 | A1 | 7/2015 | L'Heureux et al. | |
| 2016/0251114 | A1 | 9/2016 | Lee et al. | |
| 2018/0016750 | A1 | 1/2018 | Lauria et al. | |
| 2018/0222650 | A1 | 8/2018 | Zacherle | |
| 2018/0362234 | A1 | 12/2018 | L'Heureux et al. | |
| 2021/0147111 | A1* | 5/2021 | Lopez Uran | B65D 19/385 |

FOREIGN PATENT DOCUMENTS

| | | | |
|---|---|---|---|
| CN | 1522218 | A | 8/2004 |
| CN | 1890157 | A | 1/2007 |
| CN | 102648135 | A | 8/2012 |
| CN | 109328171 | A | 5/2017 |
| CN | 304640378 | S | 5/2018 |
| CN | 109451723 | A | 3/2019 |
| CN | 109789956 | A | 5/2019 |
| DE | 19521687 | A1 | 2/1996 |
| EM | 004499879-0001 | | 5/2018 |
| EP | 1024174 | A1 | 8/2020 |
| FR | 1602377 | A | 11/1970 |
| GB | 2475622 | A | 5/2011 |
| WO | 03004377 | A1 | 1/2003 |
| WO | 2003044279 | A1 | 5/2003 |
| WO | 2017192472 | A1 | 11/2017 |
| WO | 2018013397 | A1 | 1/2018 |

OTHER PUBLICATIONS

International Search Report of PCT/MX2020/050032 with English translation.

Edible Six Pack Ring (via E6PR.com), available Mar. 28, 2017, [online], [site visited Jan. 7, 2018]. Available from internet, <URL: https://web.archive.org/web/20170328162325/https://www.e6pr.com/.

Saltwater Brewery "Edible Six Pack Rings" (via YouTube.com), available May 12, 2016, [online], [site visited Jan. 7, 2018]. Video available from internet, <URL: https://www.youtube.com/watch?v=-YG9gUJMGyw.

Fishbone Packaging Inc., available Feb. 10, 2016, [online], [site visited Jan. 7, 2018]. Video available from internet, <URL: https://web.archive.org/web/20160210131122/http://www.fishbonepackaging.co/.

Daikin America; Unidyne TG-8811 Technical Data Sheet; Revised Feb. 9, 2016; https://Daikin-america .com/wp-content/uploads/2013/07 /TDS-TG-018-TG-8811-Surface.pdf; full page of Technical data Sheet.

International Search Report of Patent App. No. PCT/US17/40808 dated Sep. 28, 2017.

Niland, O., "Brewery replaces plastic six-pack rings with fish food," May 19, 2016; Mashable .com; http://mashable.com/2016/05/20/edible-six-pack-rings-beer/#4e1Wy45d F Gq D; pp. 2-4 of pdf file.

Photographs published on Facebook on and before Jan. 4, 2018, accessed and downloaded on Dec. 3, 2020 from: http://facebook.com/photo?fbid=1904539073190516.

International Search Report of Patent App. No. PCT/MX2020/050032 dated Apr. 1, 2021.

Ascheri et al. Preparation Pregelatized Flour by Thermoplastic Extrusion-Based Bagasse Barley and Corn Grits (Year: 2016).

Happiness Moon, Molded Paper Pulp (http://www.paperpulp-tableware.com/molded-paper-pulp.html). (Year: 2014).

English Machine Translation of FR1602377A.

English Machine Translation of CN1522218A.

English Machine Translation of CN1890157A.

English Machine Translation of CN102648135A.

English Machine Translation of CN109328171A.

English Machine Translation of CN109451723A.

English Machine Translation of CN109789956A.

Office Action from the Australian Patent Office dated Dec. 4, 2023 for the parallel Australian Patent Application No. 2020349372 in Australia.

Extended European Search Report from the European Patent Office dated Oct. 2, 2023 for the parallel European Patent Application No. 20865274.3 in Europe.

English Translation of the Office Action from the Chinese Patent Office dated Nov. 16, 2023 for the parallel Chinese Patent Application No. 202080077752.1 in China.

Machine English Translation of the Office Action from the Chinese Patent Office dated Aug. 9, 2024 for the parallel Chinese Patent Application No. 202080077752.1 in China.

* cited by examiner

EDIBLE CAN HOLDER WITH FLAPS

FIELD OF INVENTION

The present invention consists of a modification in the configuration and structure of a multi-ring can holder, produced from a biodegradable pulp paste, recycled, 100% biological, compostable and edible. Particularly, the present invention that modifies the configuration and structure of a can holder produced from a biodegradable pulp paste, recycled, 100% biological, compostable and edible, gives it an improvement in terms of its function and handling, since it allows to facilitate its maneuverability when distributing the can holders in the assembly area, to be able to insert the cans into the can holder and also, it grants a point of support to be able to detach the cans from the can holder manually, avoiding destruction or damage to the structure of the can holder.

BACKGROUND OF THE INVENTION

The following applications are incorporated by reference for all purposes, as if submitted herein in full, as background to disclosure to this application; application MX/u/2019/000154 "UTILITY MODEL OF A SYSTEM FOR ASSEMBLING A MULTI-RING EDIBLE BINDER" and MX/a/2019/000557 "EDIBLE CAN HOLDER AND METHODS FOR MANUFACTURING EDIBLE CAN HOLDERS".

Similarly, the Mexican patent MX179288 refers to a can holder adapted to hold a number of cans, each can has an annular upper head and a generally tapered bottom to allow the cans to be stacked collectively on top of each other, the carrier is characterized because it comprises: a generally flat carrier sheet of a piece that has a plurality of can stacking members that are projected upwards of it to establish a corresponding plurality of can stacking platforms; and can stacking platforms have (i) an annular roof wall that defines an annular closure channel that corresponds exactly to the upper ridge of a can, (ii) a central platform wall (iii) an annular support wall inclined downwards and inwards by integrally joining the lower wall to the roof wall and establishing an annular lowered region linking the wall of the central platform, which is sized and configured to accept in it the tapered bottom of another can to allow it to nest with the stacking platform. This request is silent in the formation of a fin in each corner of the carrier and refers to the region tapered in relation to the can, since this is aimed at an advantage only in the storage of beverage packages.

The Mexican patent MX241178B refers to a can holder made of cardboard, preferably corrugated cardboard, which connects a plurality of generally cylindrical cans, which is placed in at least two rows and has a sloping top and a top closure with a protruding circular ring. The carrier is produced from a piece in flat coarse, which has, for each can to be connected by the carrier, two reciprocally opposed, essentially arched indentations, the outer edges of which clutch below the ring of the cans when the carrier is assembled on the plurality of cans to connect the carrier and the cans and form a package assembly of cans. The fastening recesses, adapted to be fastened by the fingers so that they lift and handle the assembly of can package, are centrally located in the rough piece of the carrier between the rows of cans, the invention also refers to a piece in flat rough for a cardboard carrier and a method for assembling a flat piece of cardboard. This patent refers only to the general disposition of the bearer, and whose advantage at the time of its disclosure was the homology of its resistance to withstand beverage cans given the material of manufacture.

The international application WO/2003/004376, refers to a support for cardboard cans, preferably corrugated cardboard, to connect a plurality of usually cylindrical cans, arranged in one or several rows and having a sloping top and a top closure with a circular protruding edge. The bracket is produced from a flat blank, which has, for each can that can be connected by the bracket, two essentially mutually opposite arched grooves, the outer edges of which are hooked under the edge of the cans when the carrier is assembled into the plurality of cans to connect the carrier and the cans and form a package assembly. The essentially arched indentations comprise an arched intermediate section and arched extreme sections on both sides of these, forming this intermediate section radially within the extended arched arch final sections, so that a hook tab is formed that projects inwards between the final sections. The tab is adapted to rest and hook under the edge to connect the conveyor and cans to a package assembly. The invention also relates to a blank cardboard plane for a can holder. This patent although it refers to a tongue, it refers to the arrangement of the packaging and cans and never mentions a modification in the detachment of the can with the packaging.

BRIEF DESCRIPTION OF THE INVENTION

The utility model of the present invention relates to a modification in the configuration and structure of an edible can holder formed from the pulp paste of vegetable fibers in a mold that has interior cavities to contain the space for at least four and/or six rings, to transport beverage cans, which gives it advantages in terms of its usefulness.

In accordance with patent application No. MX/a/2019/000557 "EDIBLE CAN HOLDERS AND METHODS FOR MANUFACTURING EDIBLE CAN HOLDERS", the can holder is produced from a biodegradable, recycled, 100% biological, compostable, edible and therefore environmentally friendly pulp paste.

In accordance with application MX/u/2019/000154 "UTILITY MODEL OF A SYSTEM FOR ASSEMBLING AN EDIBLE MULTI-RINGATAS PORTAL", a novel machine is conceived, with the specific mechanical adjustment for the installation of a can holder, edible, of multiple biodegradable rings on the cans, to which the patent application MX/a/2019/000557 "EDIBLE CAN HOLDERS AND METHODS TO MANUFACTURE EDIBLE CAN HOLDERS" refers.

This application concerns a novel structure that gives advantages in terms of its usefulness to a multi-ring can holder, which is manufactured from a biodegradable, recycled, 100% biological, compostable and edible pulp paste, which consists of four extended fins, each configured in each corner of the structure of the can holder.

The modification referred to in the application for a utility model of interest, based on the structure and configuration of the can holder provided for in patent application MX/a/2019/000557 "EDIBLE CAN HOLDER AND METHODS FOR MANUFACTURING EDIBLE CAN HOLDERS" has the advantages of speeding up the process of installing the can holder, edible, multiple biodegradable rings on the cans and facilitating the manual removal of the can from the can holder, by the consumer, without causing damage or rupture to the complete structure of the can holder and/or the fastening rings of the can holder, nor compromising the fastening and stable fixation of the remaining cans, allowing it to maintain its rigid structure during its useful life and until the total of the cans it holds is manually detached, by consumers.

Patent application MX/a/2019/000557 "EDIBLE CAN HOLDER AND METHODS FOR MANUFACTURING EDIBLE CAN HOLDERS", does not make specific reference to the shape of the structure or shape of the can holder, since this invention only refers to its novel composition, the result of an inventive step and its manufacturing method. The patent application referred to above, although it reflects that a rigid structure is obtained in the can holder, from a biodegradable pulp paste, recycled, 100% biological, compostable, edible and technically, capable of being able to hold the cans, inside the can holder, in a safe and stable way, it was detected that at the time of being manipulated by the user and detaching, Manually the cans, could generate damage to the structure of the can holder by users, not having a sufficiently rigid, stable point of support and with the necessary surface to facilitate the detachment of the cans without compromising the structure of the can holder.

Therefore, the present invention consists of incorporating a fin-shaped body to the structure of the can holder from a biodegradable pulp paste, recycled, 100% biological, compostable and edible, with the surface and rigidity, structurally required, to act as a point of support in the can holder and facilitate the detachment of the cans, manually, avoiding damage or breakage to the structure of the can holder.

Likewise, it was also determined that having a fin with a thickness not exceeding 1.2 mm, in relation to the rest of the body of the can holder whose thickness is from 2.0 to 3.0 mm and the radial of the fin, where its radial at the widest point is 20 mm in radius, does not require modifying the mechanical structure of the can holder assembly machine, referred to in utility model MX/u/2019/000154 "UTILITY MODEL OF A SYSTEM FOR ASSEMBLING A MULTI-RING EDIBLEATAS PORTAL. On the contrary, the addition of the fins in each of the corners of the can holder, with the surface and radial at its widest point, referred to above, facilitates the way to separate each of the can holders in the distribution area so that they can be placed in the group of 4 or 6 cans, respectively, improving the times in the distribution and assembly of each of the can holders in the assembly machine.

The systems, apparatus and methods provide edible, multi-ring can holders with the ability to degrade rapidly in exposure to the environment and be nutritionally neutral when consumed by an animal (birds or fish), allowing them to be environmentally friendly.

Although the edible, multi-ring can holder, provided for in patent application MX/a/2019/000557 "EDIBLE CAN HOLDER AND METHODS FOR MANUFACTURING EDIBLE CAN HOLDERS" fulfills the function for which it was conceived, it was proven that a modification in terms of its configuration and physical structure, through the inclusion of four fins, each placed in the corners of the structure of the can holder, it would generate advantages in terms of its usefulness both in the assembly and placement stage in the cans as well as to reinforce the durability of its structure when manipulated by consumers, when removing each can fastened and facilitating maneuverability.

BRIEF DESCRIPTION OF THE FIGURES

The novel aspects that are considered characteristic of the present invention will be established with particularity in the annexed claims. However, the invention itself, both by its organization, as well as by its method of operation, together with other objects and advantages of it, will be better understood in the following detailed description of the modalities of the present invention, when read in relation to the accompanying drawings, in which:

DETAILED DESCRIPTION OF THE INVENTION

Figure 1A:
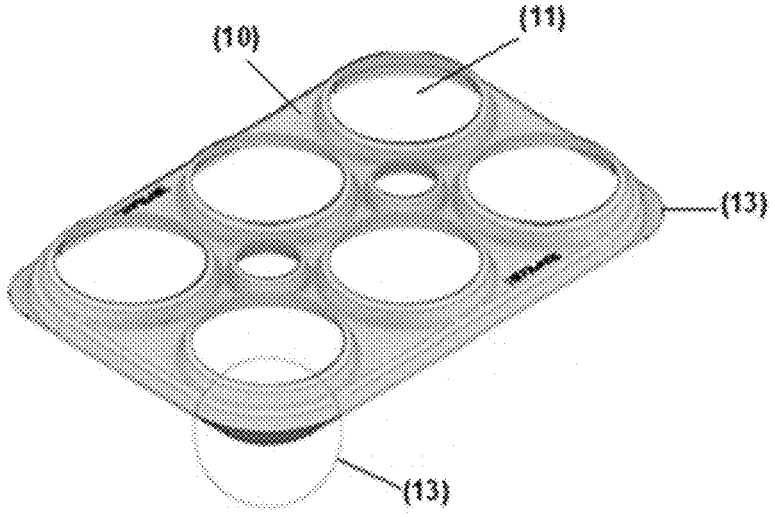
FIGS. 1A and 1B correspond to an isometric view of the can holder (10) of six and four rings (11) where one of the four fins (13) that forms in each corner of the body of this one stands out.

The specific structural and functional details described here should not be interpreted as limiting, but simply as a basis for claims and as a representative basis for teaching a technical expert how to employ innovation to the structure of the can holder (10).

Before novel modifications to the structure of the can holder are described (10), it should be understood that the terminology used in this document is intended to describe only particular embodiments and is not intended to be limiting. The terms "comprises", "comprising" or any other variation thereof are intended to encompass a non-exclusive inclusion of the list of elements that make up the invention of interest. An element preceded by "comprises" should not be interpreted as precluding the existence of additional identical elements. The terms "including" and/or "having," as used herein, are defined as comprising (i.e., open language). The terms "a" or "ones," as used herein, are defined as one or more than one. The term "plurality", as used herein, is defined as two or more than two. The term "other," as used in this document, is defined as at least one more. The description may use the terms "embodiments", "embodiments" or "modalities", which may refer to one or more of the same or different embodiments of the invention. The terms "fins" can refer to "bumps", "flange", "tapered region" or "tongue" of a thickness less than the rest of the body of the can holder (10), in the same way, the term "sheet" or "can holder body" should be understood as the body of the can holder (10) edible multi-ring, which is produced from a biodegradable pulp paste, recycled, 100% biological and compostable.

The terms "integrated" can be used, along with their derivatives. It should be understood that these terms are not intended to be synonymous with each other. Rather, in particular embodiments, "integrated" can be used to indicate that two or more elements are in physical contact with each other. "Coupled" can mean that two or more elements are in physical contact. However, "coupled" as used in the present invention refers to an element that derives from the same body of the main structure, such as knives integrated into the rollers.

The invention is constructed of the same composition as the can holder (10) described in patent application MX/a/2019/000557 "EDIBLE CAN HOLDER AND METHODS FOR MANUFACTURING EDIBLE CAN HOLDERS". The sheet that serves to form the structure of the can holder (10), has been modified at its ends to give configuration to the structure of each of the fins.

Therefore, a main object of the invention is to provide a novel arrangement in the configuration and structure of the sheet of the biodegradable can holder (10) for unified transport of a group of beverage cans in a single package, where said new modification of the can holder (10) is distinguished by comprising in each corner a protrusion, tab, tapered region or tongue of a thickness (E), between 0.75 mm to 1.8 mm, from the sheet of can holders (10) whose thickness is between 2.0-2.5 mm. This protrusion, tab, tapered region or tongue, for reference of the present invention, will be considered as fin (13).

It is another object of the invention, to provide a novel arrangement in the configuration and structure of the sheet of the biodegradable can holder (10), which allows the user/consumer, to be able to detach more easily and efficiently the can, from the can holder (10), without generating damage to the rigid structure of the can holder (10).

It is still another object of this invention to provide an accessory, whose dimensions by the design of its fins (13) in its structure, does not alter the transport and storage capacity, allowing to stack horizontally and vertically the same number of can holders that derives from the patent application MX/a/2019/000557 "EDIBLE CAN HOLDERS AND METHODS TO MANUFACTURE EDIBLE CAN HOLDERS", as well as not compromising the rigidity and stability of the can holder with other cans when a can is released.

Similarly, it is another object of the invention, that the incorporation of the fins (13) in the structure of the can holder (10) referred to in the patent application MX/a/2019/000557 "EDIBLE CAN HOLDER-CANS AND METHODS TO MANUFACTURE EDIBLE CAN HOLDERS", contains the appropriate thickness and surface so as not to require modifying the mechanical structure of the can holder assembly machine, referred to in utility model MX/u/2019/000154 "UTILITY MODEL OF A SYSTEM FOR ASSEMBLING A MULTI-RING EDIBLEATAS PORTAL. On the contrary, the addition of the fins in each of the corners of the can holder, with the surface and radial at its widest point, facilitates the way to separate each of the can holders in the distribution area so that these can be placed in the group of 4 or 6 cans, respectively, improving the times in the distribution and assembly of each of the can holders in the assembly machine.

The advantages of providing an edible and biodegradable can holder (10), made of vegetable pulp, are multiple, however given its origin, consistency and structural nature, it is a rigid sheet, since the point of support for the user is at the time of detaching a can is the same can holder (10), there is a risk of bending or mistreating the rings neighboring the detached can, so the generation of a tab in each corner of the can holder, of less thickness than the rest of the can holder body, greatly facilitates this maneuver, this advantage in the arrangement of the sheet arises from the fact that, these protrusions in the corners are used by the assembly machine to be able to separate the can holders (10) when they are stacked and then allow them to be applied to the cans; accelerates and facilitates the separation of the can holders (10) when they are glued since the assembly machine has different types of mechanisms that use the protrusions of the corners to pull them. These mechanisms manage to range from low speeds of 6 can holders per minute to 400 can holders per minute depending on the speed required.

According to the present invention the fins (13) formed from the body of the can holder, does not significantly alter the dimensions of the original sheet, which allows the machine to assemble the sheet (10) to the cans with the same mechanism for a can holder without fins as for the can holder with fins, in this way, when stacking the packages, it does not require a surface greater than that required for a surface necessary to pack 6 and/or 4 cans.

Figure 2:
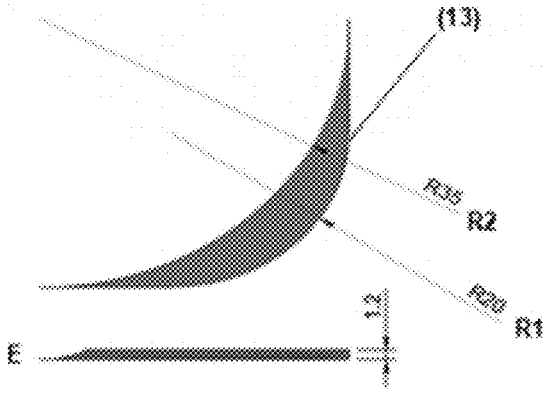
FIG. 2 corresponds to an approach to one of the fins (13) where the radius (R1) and thickness (E) of said tapered region of the can holder is indicated.

More preferably, the fins or protrusions of the can holder, do not have a thickness (E) greater than 1.2 mm, in relation to the rest of the body of the can holder whose thickness goes from 2.0 to 3.0 mm, and the radial of the fin goes from a radius of 35 mm (R2) to 20 mm (R1), where in its widest region the radial is a radius of 20 mm (R1), as shown in FIG. 2. This thickness and amplitude in the fin allows excellent maneuverability when separating the can holders when they are stacked and also allows to improve the distribution of the can holders in the assembly machine, since the assembly machine finds a greater protrusion at each of the ends, whose surface is smaller than the rest of the body of the can holder, thus allowing the rollers or mechanisms intended to separate each of the stacked bodies from the can holder, to be easily held by the rollers for removal from the stacked can holder body and then the can holder can be inserted into the can body.

Figure 1B:
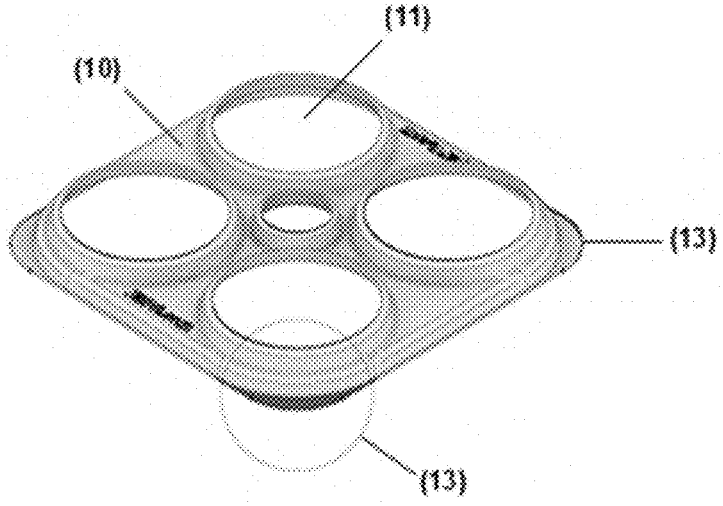
Figure 3:
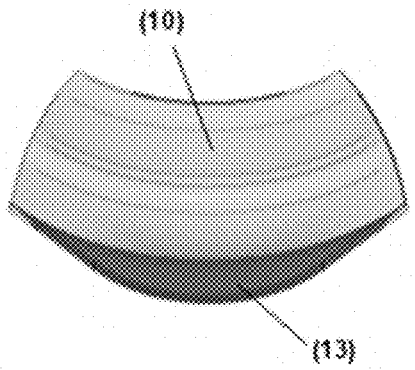
FIG. 3 corresponds to an approach of one of the fins (13) from the body of the can holder (10), at a scale of 1:0.7, where the fin region (13) is formed from the body of the can holder (10), without being an additional structure or a structure extending beyond the original dimensions of the can holder (10).
Figure 4:
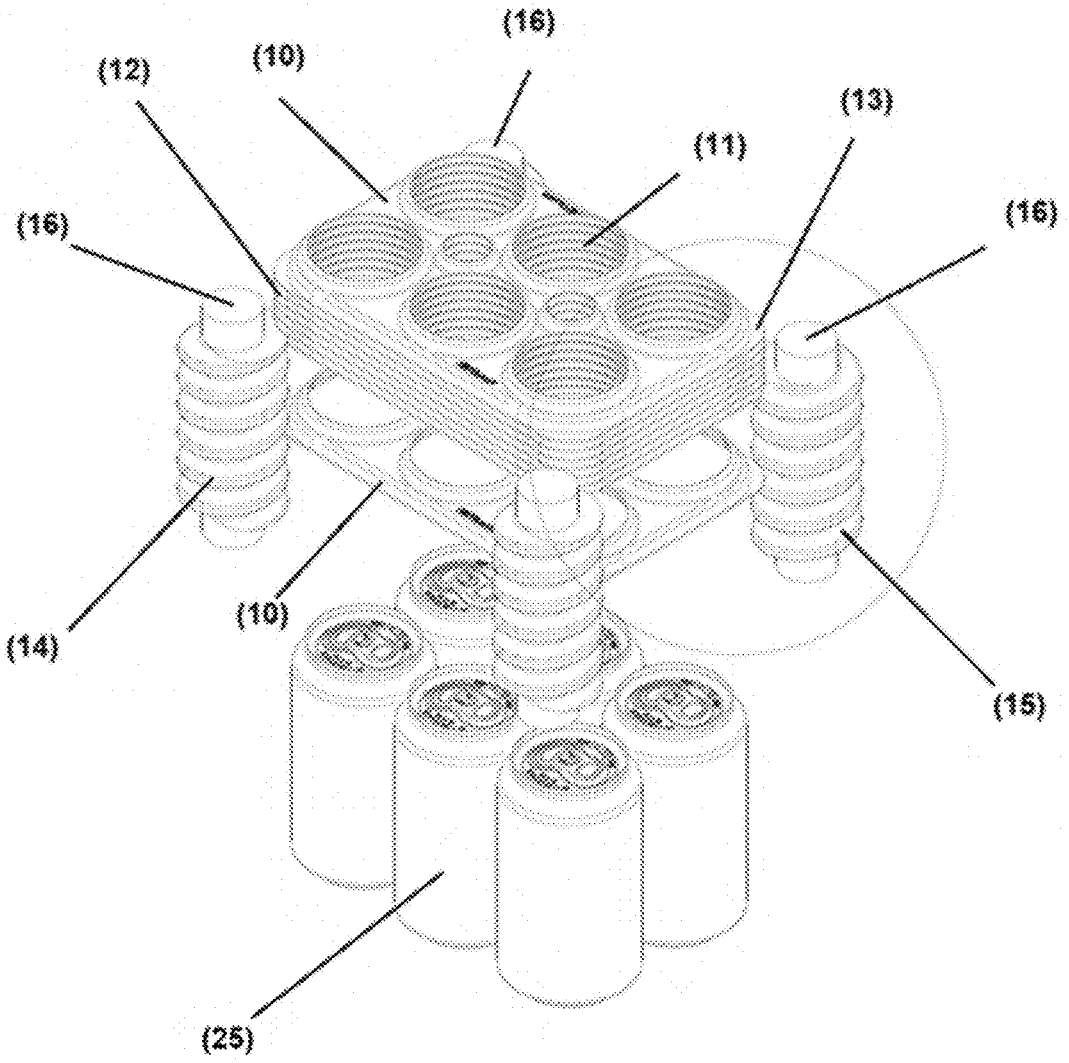
FIG. 4 corresponds to a perspective view that outlines the mechanism of formation of the fins from a can holder (10), either of 6 or 4 rings (11), which pass through the assembly machine that, in its last stage, passes through 4 rollers (16) with knives (14 and 15), simultaneously, located in each corner of the can holder (10) of six cans (25).
Figure 5:
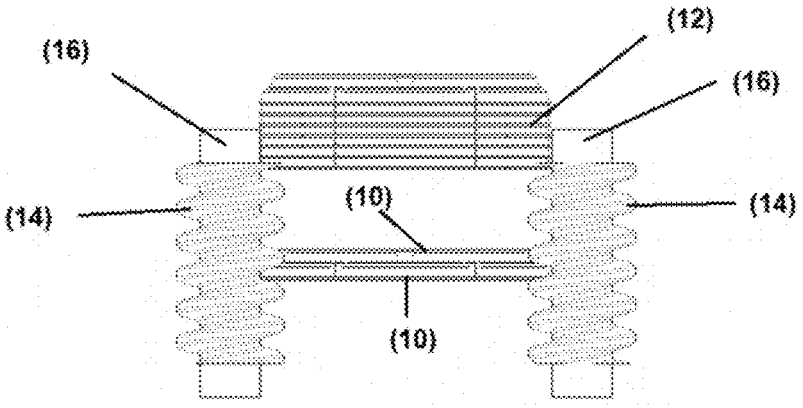
FIG. 5 corresponds to a side view, where it is observed how from a pile of sheets holders (10), they are separated and one by one pass through the rollers (16) with knives (14 and 15) that lower each corner, forming the fins (13).

According to the present invention, the fin (13) is not an additional element, coupled to the body of the can holder (10), but is a small extension from the body of the can holder (10), the result of a modification as to the structure of the pot-cans (10), that is, the fins (13) are formed from the same edible and biodegradable material of the rest of the body of the can holder (10), as shown in FIG. 3, which only highlights in the dark the region that makes up the fin (13), and can be more clearly evidenced in FIGS. 1A and 1B.

The shape of the fin (13) gives a rather oval silhouette to the final structure of the can holder (10), as shown in FIGS. 1*a* and *b*, which provides practicality in handling and reduces the risk of damage during its maneuverability, since, in many packages, of various products comprising a fin (13), they form a peak or corner at 90°, which, being a rigid structure could, from mistreating neighboring material as some damage during handling. Therefore, each of the fins (13), being of a lower surface than the rest of the body of the can holder (10), gives flexibility when used as a point of support, absorbing the torsional force at the moment when the can holder can is removed manually (10).

Preferably, the formation of the fins (13) is carried out at the time of forming the entire structure of the body of the can holder (10), which as referred to in the utility model MX/u/2019/000154 "UTILITY MODEL OF A SYSTEM TO ASSEMBLE AN EDIBLE MULTI-RINGATAS PORTAL, are stacked in the assembly machine, where rollers (16) or in its generality, the mechanism that allows the removal of each of the can holders (10) stacked, which is illustrated as a roller (16) for easy reference, but is not exclusive of other types of removal mechanisms, uses the fins (13) as a clamping shaft to be able to detach, more easily, each of the can holders (10). This advantage is obtained at the moment when each of the fins (13), has a thickness (E) less than the thickness that comprises the rest of each of the can holders, which means that the distribution mechanism can take each of the fins and separate it efficiently, thus preventing the can holders from sticking together or that two or more can holders can detach together. Thus, any error in the distribution machine is avoided, since it can separate in a constant, orderly and sequential way, each of the stacked can holders (10).

Figure 6:
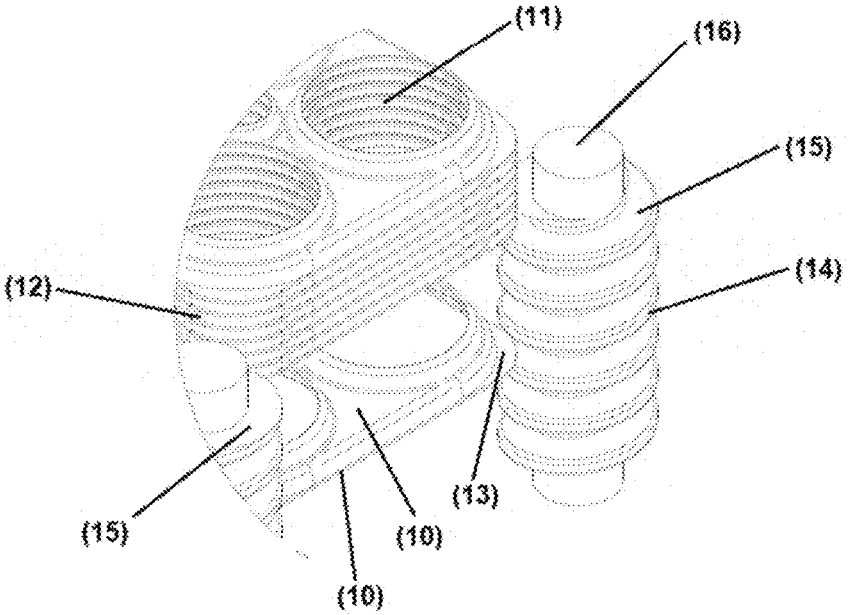
FIG. 6 corresponds to a perspective view with approach to one of the four rollers (16), where it is observed how the knife (14 and 15) contained in the roller (16), simultaneously lowers the corners of the can holder (10) decreasing the thickness, with respect to the rest of the sheet.

According to the present invention and as observed in FIG. 6, the present modification to the structure of the can holder (10), that is, the addition of the fins (13) at each end of the can holder (10), allow the constant, orderly and sequential separation of 6 to 400 can holders per minute.

Although the invention has been shown and described with respect to a certain preferred modality or modalities, equivalent alterations and modifications are incorporated as non-limiting modalities to the scope of protection of this invention.

Therefore, it is contemplated that the claims will cover any of these modifications or modalities that fall within the true scope of the invention.

It is noted that in relation to this date the best method known to the applicant to put the said invention into practice is the one that is clear from the present description of the invention.

The invention claimed is:

1. A compostable and edible multi-ring can holder for transporting four to six beverage cans, comprising:

a. a body composed of a sheet having multiple rings formed therein, the sheet having a minimum thickness and a maximum thickness; and b. wherein the minimum thickness of the sheet is 2.0 mm and the maximum thickness of the sheet is 3.0 mm;

c. wherein the body of the can holder includes an upper face with four to six openings to receive the beverage cans, and a downward sloping face extending from the upper face;

d. wherein the downward sloping face of the body of the can holder makes up at least four corners that each have an outwardly convex shape;

e. wherein one fin extends outwardly in the same outwardly convex direction from the lowermost portion of each of the at least four corners of the downward sloping face of the body of the can holder, wherein each of the one or more fins has a thickness that is less than the maximum thickness of the sheet;

f. wherein each of the fins is rounded and has a radial of between 20 mm and 35 mm;

g. wherein the thickness of each of the fins is between 0.75 mm to 1.8 mm;

h. wherein each fin is configured to facilitate separation of a plurality of stacked multi-ring can holder bodies;

i. wherein the multi-ring can holder is (i) produced from a biodegradable pulp paste of vegetable fibers, (ii) is recyclable, (iii) is 100% biological, (iv) is compostable, and (v) is edible.

2. The can holder, in accordance with claim 1, wherein each fin facilitates the handling and maneuverability of the can holder at the time of manual removal of each of the cans inserted in it.

3. The can holder, in accordance with claim 1, wherein each fin allows the assembly machine to separate the can holder from other can holders in stack in a constant, orderly and sequential manner.

4. The can holder, in accordance with claim 1, wherein the minimum thickness of the sheet is 2.0 mm and the maximum thickness of the sheet is 2.5 mm.

5. The can holder, in accordance with claim 1, wherein each fin has a thickness that is also less than the minimum thickness of the sheet.

6. The can holder, in accordance with claim 5, wherein each fin facilitates the creation of a separation space between the can holder and other can holders in a stack of can holders.

7. The can holder, in accordance with claim 1, wherein each fin is formed from the same material as the body.

* * * * *